US011692458B1

(12) United States Patent
Kucza et al.

(10) Patent No.: US 11,692,458 B1
(45) Date of Patent: Jul. 4, 2023

(54) SYSTEMS AND METHODS OF PROTECTING METALLIC ENGINE COMPONENTS FROM CORROSION

(71) Applicants: General Electric Company, Schenectady, NY (US); OLIVER CRISPIN ROBOTICS LIMITED, Cheshire (GB)

(72) Inventors: Nikole Joy Kucza, Cudahy, WI (US); Aida Amroussia, Paris (FR); Katherine Quinn, Troy, NY (US); Keith Anthony Lauria, Wells, NY (US); Jack E. Howson, Troy, NY (US); Andrew Crispin Graham, Badminton (GB); Erica Sampson, Mount Pleasant, SC (US); Eric S. Huron, West Chester, OH (US); Vijayaraghava Venkata Nalladega, Mason, OH (US)

(73) Assignees: General Electric Company, Schenectady, NY (US); Oliver Crispin Robotics Limited, Altrincham (GB)

( * ) Notice: Subject to any disclaimer, the term of this patent is extended or adjusted under 35 U.S.C. 154(b) by 0 days.

(21) Appl. No.: 17/853,240

(22) Filed: Jun. 29, 2022

(51) Int. Cl.
*F01D 25/00* (2006.01)
*F01D 25/24* (2006.01)

(52) U.S. Cl.
CPC ..... *F01D 25/007* (2013.01); *F01D 25/24* (2013.01); *F05D 2220/323* (2013.01); *F05D 2230/90* (2013.01); *F05D 2240/14* (2013.01); *F05D 2300/121* (2013.01); *F05D 2300/611* (2013.01)

(58) Field of Classification Search
CPC ..... F01D 25/007; F05D 2230/90; F05D 2300/611
See application file for complete search history.

(56) References Cited

U.S. PATENT DOCUMENTS

| | | | | |
|---|---|---|---|---|
| 6,143,243 | A | 11/2000 | Gershun | |
| 6,485,780 | B1 | 11/2002 | Sangeeta | |
| 8,597,724 | B2 | 12/2013 | Bunting | |
| 9,322,101 | B2 | 4/2016 | Belov | |
| 11,066,952 | B2 | 7/2021 | Hanlon | |
| 2007/0248457 | A1 | 10/2007 | Dodd | |
| 2017/0254936 | A1* | 9/2017 | Morita | B32B 37/02 |
| 2018/0198006 | A1* | 7/2018 | Greer | H10K 71/12 |
| 2019/0024256 | A1 | 1/2019 | Riehl | |
| 2019/0071769 | A1* | 3/2019 | Kirby | C04B 41/89 |

(Continued)

FOREIGN PATENT DOCUMENTS

| | | |
|---|---|---|
| WO | 2021183212 | 9/2021 |
| WO | 2021226699 | 11/2021 |

*Primary Examiner* — Long T Tran
(74) *Attorney, Agent, or Firm* — Fitch, Even, Tabin & Flannery, LLP

(57) ABSTRACT

Methods of protecting a metallic substrate from corrosion include introducing an aqueous or powder-form composition including at least one corrosion inhibitor into a crevice that traverses one or more layers covering the metallic substrate to deliver the composition via the crevice into contact with a surface of the metallic substrate. The corrosion inhibitors present in the composition bond to the surface of the metallic substrate, resulting in formation of a film on the surface of the metallic substrate. This film protects the surface of the metallic substrate against corrosion.

20 Claims, 2 Drawing Sheets

(56) References Cited

U.S. PATENT DOCUMENTS

| | | | | |
|---|---|---|---|---|
| 2019/0324341 | A1* | 10/2019 | Tonar | B32B 27/365 |
| 2022/0002883 | A1* | 1/2022 | Mandal | B64F 5/40 |
| 2022/0050051 | A1* | 2/2022 | Mandal | C11D 7/3245 |

* cited by examiner

SYSTEMS AND METHODS OF PROTECTING METALLIC ENGINE COMPONENTS FROM CORROSION

TECHNICAL FIELD

This disclosure relates to protection of metallic surfaces from corrosion and, more particularly, to methods of protecting metallic surfaces of aircraft engines from corrosion using protective compositions that include one or more corrosion inhibitors.

BACKGROUND

This disclosure relates to protection of metallic surfaces from corrosion and, more particularly, to methods of protecting metallic surfaces of aircraft engines from corrosion using protective compositions that include one or more corrosion inhibitors.

Certain components of aircraft engines are made of metals such as aluminum, aluminum alloy, etc. Such metallic components are susceptible to corrosion and are often provided with a physical barrier coating to protect them from corrosion. Ambient air typically encountered by an aircraft during flight often contains moisture and presents a corrosive environment that can cause conventional physical barrier coatings to be dissolved over time. When this happens, a new physical barrier coating layer needs to be applied, and this process is typically labor-intensive (e.g., requires partial or full disassembly of the engine) and costly. As such, there is a need for improved methods of protecting hard to reach aluminum components against corrosion.

Common methods for corrosion protection of aluminum components of aircraft engines include coating the surface of the bare substrate with a conventional coating or paint which provides a physical anti-corrosive barrier. Over the course of the life of an aircraft, this coating is exposed to various elements (e.g., moisture) and as a result deteriorates, dissolves, or otherwise loses integrity as a physical barrier. When the physical barrier coating starts to fail (e.g., by developing chips, cracks, spallation, etc.), it must be repaired to a like-new condition to continue its function as a moisture barrier. A conventional repair process includes multiple steps. These steps can include masking the component in non-damaged areas, completely stripping the physical barrier coating, applying a new physical barrier coating, and air curing the physical barrier coating to promote adhesion of the new coating to the bare substrate.

Stripping and reapplying a new physical barrier coating can be relatively time consuming and costly and has potential scrap impact to the component. The stripping processes usually require several iterations. Chemically treated components may require abrasive mechanical cleaning, for example, by aggressive grit blasting to provide a sufficiently clean surface for the process. Repeated chemical and mechanical cleaning of components can excessively remove material from the surface of the metallic component, which is undesirable. Thus, it is desirable to repair and/or prevent corrosion of metallic components in a manner that does not excessively or substantially remove or alter the material properties of the base metal of the metallic components.

The presently known localized repair methods of conventional physical barrier coatings involve manually brushing on the replacement physical barrier coating, which can result in a less-effective coating due to the interface mismatch between the original coating and the new repair coating. Notably, the current industry standard for aluminum physical barrier coatings heavily relies on regulated or restricted substances such as hexavalent chrome. Consequently, these conventional methods are being phased out of production in view of international regulations, specifically the Registration, Evaluation, Authorisation, and Restriction of Chemicals (REACH) regulations, governed by the European Chemicals Agency (ECHA).

BRIEF DESCRIPTION OF THE DRAWINGS

Described herein are embodiments of methods of protecting metallic components of aircraft engines from corrosion. This description includes drawings, wherein.

Elements in the figures are illustrated for simplicity and clarity and have not been drawn to scale. The dimensions and/or relative positioning of some of the elements in the figures may be exaggerated relative to other elements to help to improve understanding of various embodiments. Also, common but well-understood elements that are useful or necessary in a commercially feasible embodiment are often not depicted in order to facilitate a less obstructed view of these various embodiments. Certain actions and/or steps may be described or depicted in a particular order of occurrence while those skilled in the art will understand that such specificity with respect to sequence is not actually required.

The terms and expressions used herein have the ordinary technical meaning as is accorded to such terms and expressions by persons skilled in the technical field as set forth above except where different specific meanings have otherwise been set forth herein.

DETAILED DESCRIPTION

The following description is not to be taken in a limiting sense, but is made merely for the purpose of describing the general principles of exemplary embodiments. Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment.

The methods of protecting metallic surfaces against corrosion described herein work well in conjunction with the hard-to-reach conventional physical barrier coatings already in place. Generally speaking, after the failure of a conventional physical barrier coating, the methods described herein utilize moisture/water, already present at the surface of the metallic component due to environmental exposure, to transport a protective composition (which may be a solution or a powder) to the exposed metal surface, where this solution provides protection against corrosion.

In some aspects, the corrosion inhibitors present in the protective compositions described herein bond to the surface of the metallic substrate and form a thin protective film that disrupts galvanic cells and slows down the rate of corrosion of the metallic substrate. For in-situ repairs, the protective compositions and methods of their administration described herein are ideal, since they effectively reach hard-to-reach areas, utilizing the existing aqueous environment, which eliminates the need for engine tear-down and disassembly. Overall, the application of the protective material as described herein will advantageously extend the life of aluminum components while saving time and money not only in repair, but also by way of scrap reduction.

Figure 1:
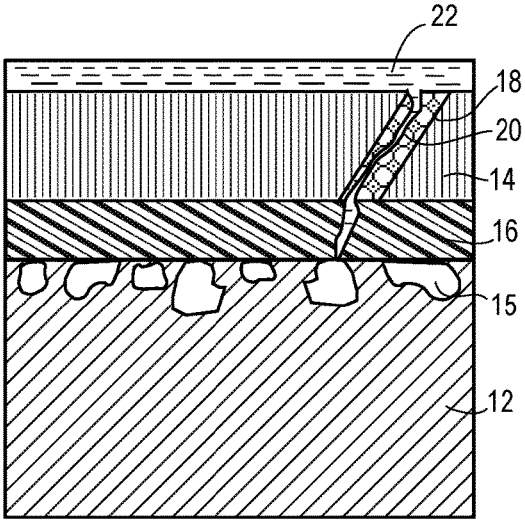
FIG. 1 PRIOR ART
FIG. 1 is a schematic cross-section of a prior art corrosion protection system, showing how moisture gets into a crevice of an anti-corrosion protective material and seeps therethrough into contact with the metal substrate.

FIGS. 1-4 illustrate the typical progression of corrosion of metallic surfaces protected by conventional physical barrier coatings. FIG. 1 shows a metallic substrate 12 (e.g., aluminum, aluminum alloy, etc.) having a conventional physical barrier (anti-corrosive) coating 14 (e.g., honeycomb composite, hexavalent chromate, etc.). The metallic substrate 12 may be an aluminum or aluminum alloy (e.g., aluminum fan casing in an aircraft engine or any similar aviation component or equipment). In FIG. 1, the physical barrier coating 14 is attached to the metallic substrate 12 via an adhesive layer 16, which may be in the form of a single layer of a single adhesive or a blend of adhesives, or may comprise two or more layers (e.g., adhesive film and bond primer).

The exemplary anti-corrosion physical barrier coating 14 illustrated in FIG. 1 is a honeycomb composite (Nomex®, DuPont), which is typically spliced together using a foam-based expandable adhesive 18. During operation of a turbofan aircraft engine, it is not uncommon for an aqueous medium/aqueous solution 22 (e.g., moisture, water) to come into contact with the physical barrier coating 14 at the seams, where adjacent sections of the physical barrier coating 14 are joined/spliced via the foam-based adhesive 18. Often, this aqueous medium 22 may contain contaminants (e.g., salts, sulfates) that can increase the rate of a galvanic reaction with the metallic substrate 12, but an aqueous environment is typically by itself sufficient to initiate galvanic corrosion of the metal substrate 12.

Figure 2:
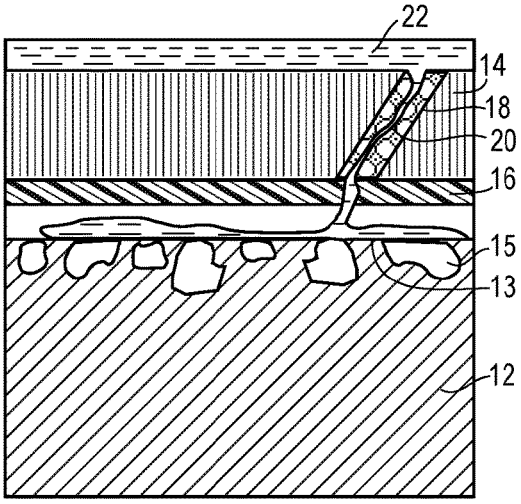
FIG. 2 PRIOR ART
FIG. 2 is a schematic cross-section of the prior art corrosion protection system of FIG. 1, showing how the moisture that got into the crevice starts dissolving the adhesive layer that attaches the anti-corrosion protective material to the metal substrate.
Figure 3:
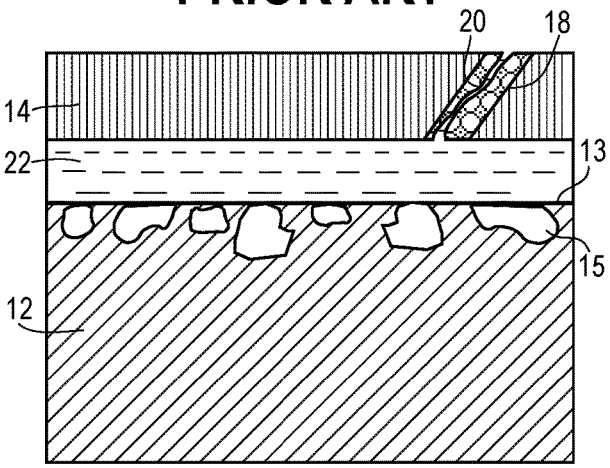
FIG. 3 PRIOR ART
FIG. 3 is a schematic cross-section of the prior art corrosion protection system of FIG. 2, showing that the moisture that got in through the crevice fully dissolved the adhesive layer between the anti-corrosion protective material and the metal substrate.
Figure 4:
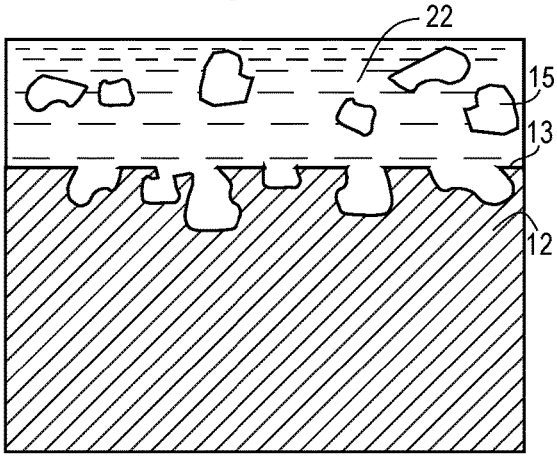
FIG. 4 PRIOR ART
FIG. 4 is a schematic cross-section of the prior art corrosion protection system of FIG. 3 after the anti-corrosive protective material delaminated from the metal substrate due to the dissolution of the adhesive layer and after metallic precipitates of the metal substrate are released into the moisture/aqueous layer, indicating that the metal substrate is undergoing galvanic corrosion.

During operation of a typical aircraft engine, it is not uncommon for the foam-based adhesive 18 to develop one or more small (e.g., hairline) crevices/cracks 20 that permit water 22 (e.g., moisture from ambient air) to seep therethrough, as shown in FIG. 1. As more and more water 22 seeps through the crack 20 and into contact with the adhesive layer 16, the water 22 starts dissolving portions of the adhesive layer 16, as shown in FIG. 2. Over time, the action of the seeping in water 22 onto the adhesive layer 16 results in the adhesive layer 16 being undercut, which causes spallation and eventually complete dissolution of the adhesive layer 16, as shown in FIG. 3. The dissolution of the adhesive layer 16 may in turn cause the delamination of the physical barrier coating 14 from the metallic substrate 12 and the release of intermetallic precipitates 15 into the water 22, as shown in FIG. 4, evidencing the corrosion of the metallic substrate 12.

The methods and systems of protecting the metallic substrate 12 from corrosion as described herein include the use of a protective composition 30 that includes one or more corrosion inhibitors 32. The composition 30 may be in the form of an aqueous solution having one or more corrosion inhibitors 32 dissolved therein. In some embodiments, the composition 30 may be in the form of a dry powder or a wetted powder.

The corrosion inhibitors 32 included in the protective composition 30 may be ECHA-compliant corrosion inhibitors and/or REACH-compliant corrosion inhibitors. For example, in some embodiments, the protective composition 30 may comprise corrosion inhibitors including, but not limited to, 8-hydroxyquinoline, 2,5-dimercapto-1,3,4-thiadiazolate, 1, 2, 4-triazone, cerium (III) chloride, 1,2,3-benzotriazole, 3-amino-1,2,4-triazole, 2-mercaptobenzothiazole, and salicylaldoxime, and combinations thereof. In one exemplary embodiment, the composition 30 includes 0.015 wt. % 8-hydroxyquinoline and 0.01 wt. % 2,5-dimercapto-1,3,4-thiadiazolate, with the remainder being water. It will be appreciated that these corrosion inhibitors are being provided by way of example only, and that, depending on the metallic substrate to be protected from corrosion, other corrosion inhibitors may be used in the composition 30 instead of, or in addition to, the above-listed corrosion inhibitors.

Figure 5:
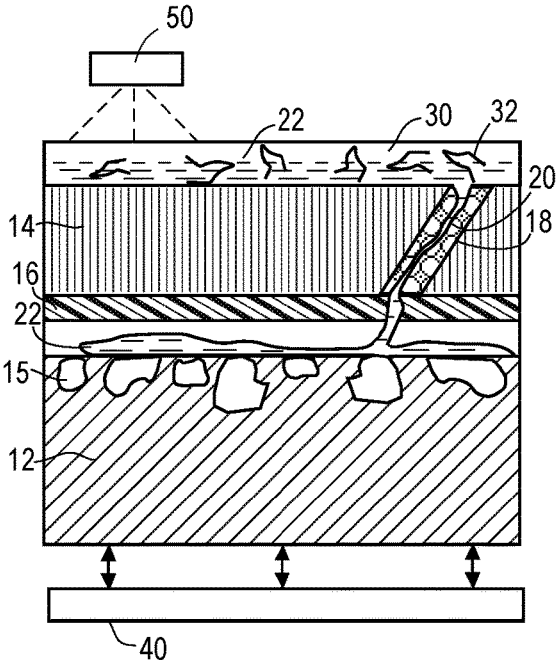
FIG. 5 is a schematic cross-section illustrating a corrosion protection method according to some embodiments, showing how the protective composition is administered into a crevice of an anti-corrosion protective material and delivered therethrough into contact with the metal substrate.

FIG. 5 shows an exemplary method of protecting a metallic substrate 12 (e.g., a component (for example, fan casing) of a turbofan aircraft engine, another (non-engine) metallic component of an aircraft, or a hard-to-reach metallic component of a ground vehicle or naval vehicle) from corrosion. In the embodiment shown in FIG. 5, the protective composition 30 is in the form of an aqueous solution, which is introduced into the crevice 20 formed in the expandable adhesive 18 (also known as a core splice), and acts as a delivery medium that transports the composition 30 containing the corrosion inhibitors 32 via the crevice 20 into contact with the otherwise hard to reach external surface 13 of the metallic substrate 12. In some aspects, the protective composition 30 (in solution or powder form) may be introduced into an aqueous medium/aqueous solution 22 present at the external surface 13 of the metallic substrate 12 and dissolves therein. In some embodiments, prior to introducing the protective composition 30 into the crevice 20, the presence of the aqueous medium 22 at the surface 13 of the metallic substrate 12 may be sensed/detected using a sensor 50 (see FIG. 5), for example, an infrared sensor, or sensor that is suitable for detecting the presence of an aqueous medium 22 at the surface 13 of the metallic substrate 12.

Figure 6:
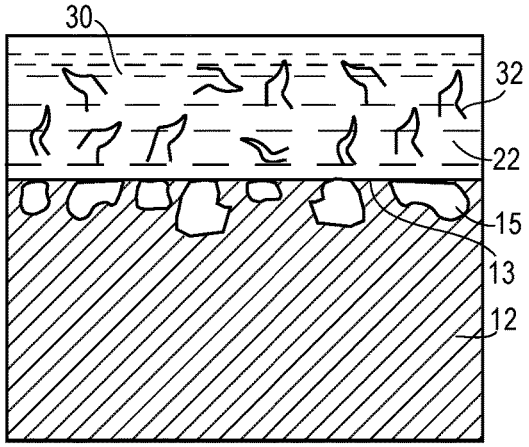
FIG. 6 is a schematic cross-section of the corrosion protection method of FIG. 5, showing the protective composition containing anti-corrosion inhibitors using the aqueous path as transportation to enable contact with the exposed external surface of the metal substrate.
Figure 7:
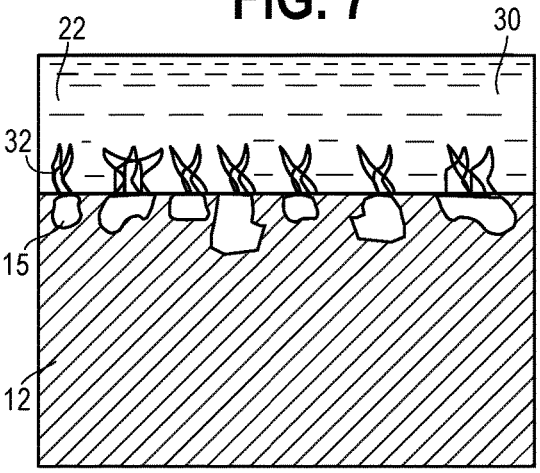
FIG. 7 is a schematic cross-section of the corrosion protection method of FIG. 6, illustrating that the anti-corrosion inhibitors present in the protective solution bond, at the external surface of the metal substrate, with the metallic precipitates present in the metal substrate.
Figure 8:
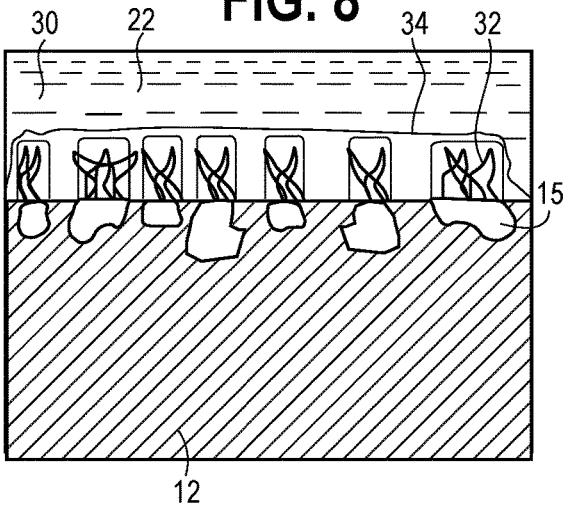
FIG. 8 is a schematic cross-section of the corrosion protection method of FIG. 7, illustrating that the bonding of the anti-corrosion inhibitors present in the protective solution to the external surface of the metal substrate results in formation of a protective film on the external surface of the metal substrate.

When the composition 30 containing the corrosion inhibitors 32 is in contact with the external surface 13 of the metallic substrate as shown in FIG. 6, the corrosion inhibitors 32 present in the protective composition 30 tend to bond to the external surface 13 of the metallic substrate 12. The bonding of the corrosion inhibitors 32 of the protective composition 30 to the intermetallic precipitates 15 or the matrix of the metallic substrate 12 as shown in FIG. 7 results in a formation of a protective film 34 overlaying (and protecting from corrosion) the external surface 13 of the metallic substrate 12, as shown in FIG. 8. This protective film 34 may be formed in 1-24 hours from the time of application of the protective composition 30. In some embodiments, vibration, which may be applied to the metallic substrate 12 and/or aqueous solution 22 via routine operation of a jet engine of an aircraft (or by a suitable vibratory device 40 (see FIG. 5)) facilitates the interaction of the corrosion inhibitors 32 dissolved in the aqueous solution 22 with the surface 13 of the metallic substrate 12, and facilitates the formation of the protective film 34 over a larger portion of the surface 13 of the metallic substrate 12.

After formation, the protective film 34 significantly slows down the rate of corrosion of the metallic substrate 12 and provides effective protection against corrosion to the external surface 13 of the metallic substrate 12. In some embodiments, the protective film 34 has a thickness of a few nanometers, for example, 1-10 nanometers, and may withstand temperatures of up to 150 degrees Fahrenheit.

Further aspects of the disclosure are provided by the subject matter of the following clauses:

There is provided a method of protecting a metallic substrate from corrosion, the method including: introducing a composition including at least one corrosion inhibitor into a crevice that extends across one or more protective layers covering the metallic substrate to deliver the composition via the crevice into an aqueous solution that contacts a surface of the metallic substrate such that the composition dissolves in the aqueous solution; wherein, in response to an interaction between the at least one corrosion inhibitor of the composition contained in the aqueous solution and the surface of the metallic substrate, a protective film is formed on the surface of the metallic substrate, and wherein the protective film formed on the surface of the metallic substrate provides the surface of the metallic substrate with protection against corrosion.

The method may include applying vibration to at least one of the surface of the metallic substrate and the aqueous solution containing the at least one corrosion inhibitor to facilitate the interaction of the at least one corrosion inhibitor with the surface of the metallic substrate and formation of the protective film on the surface of the metallic substrate.

The composition may be in a form of a solution, a dry powder, or a wetted powder. The composition may include at least one of an ECHA-compliant corrosion inhibitor and a REACH-compliant corrosion inhibitor. The composition may include at least one of 8-hydroxyquinoline, 2,5-dimercapto-1,3,4-thiadiazolate, 1, 2, 4-triazone, cerium (III) chloride, 1,2,3-benzotriazole, 3-amino-1,2,4-triazole, 2-mercaptobenzothiazole, and salicylaldoxime. The composition may include 0.015 wt. % 8-hydroxyquinoline and 0.01 wt. % 2,5-dimercapto-1,3,4-thiadiazolate.

In the method, the forming of the protective film may include bonding of the at least one corrosion inhibitor to intermetallic particles or matrix of the metallic substrate. The method may further include detecting, via a sensor, the aqueous solution in contact with the surface of the metallic substrate. In some aspects, the protective layers covering the metallic substrate may include: hexacomb composite, adhesive film, and/or bond primer, and the metallic substrate may be an aluminum or aluminum alloy component of an aircraft engine.

There is further provided a system for protecting a metallic substrate from corrosion, the system comprising: a composition including at least one corrosion inhibitor; at least two protective layers covering the metallic substrate and including a crevice that extends across the at least two layers to expose a surface of the metallic substrate; wherein the composition is dissolved in an aqueous solution located at the surface of the metallic substrate; wherein the at least one corrosion inhibitor of the composition contained in the aqueous solution interacts with the surface of the metallic substrate to form a protective film on the surface of the metallic substrate; and wherein the protective film formed on the surface of the metallic substrate provides the metallic substrate with protection against corrosion.

The metallic substrate may be a component of an aircraft, and wherein operation of an engine of the aircraft provides vibration to at least one of the surface of the metallic substrate and the aqueous solution containing the at least one corrosion inhibitor to facilitate interaction of the at least one corrosion inhibitor of the composition with the surface of the metallic substrate and formation of the protective film on the surface of the metallic substrate.

In the system, the composition may be in a form of a solution, a dry powder, or a wetted powder. In the system, the composition may include at least one of an ECHA-compliant corrosion inhibitor and a REACH-compliant corrosion inhibitor. In the system, the composition may include at least one of 8-hydroxyquinoline, 2,5-dimercapto-1,3,4-thiadiazolate, 1, 2, 4-triazone, cerium (III) chloride, 1,2,3-benzotriazole, 3-amino-1,2,4-triazole, 2-mercaptobenzothiazole, and salicylaldoxime. In the system, the composition may include 0.015 wt. % 8-hydroxyquinoline and 0.01 wt. % 2,5-dimercapto-1,3,4-thiadiazolate.

In the system, the protective film may include the at least one corrosion inhibitor bonded to intermetallic particles or matrix of the metallic substrate. The system may further include a sensor that detects a presence of the aqueous solution at the surface of the metallic substrate. In the system, the protective layers covering the metallic substrate may include hexacomb composite, adhesive film, and/or bond primer, and the metallic substrate may be aluminum or aluminum alloy component of an aircraft engine.

There is further provided a method of protecting a metallic substrate from corrosion, the method including: introducing a composition including at least one corrosion inhibitor into an aqueous solution covering the metallic substrate to dissolve the composition in the aqueous solution and deliver the at least one corrosion inhibitor into contact with a surface of the metallic substrate; and wherein, in response to an interaction between the at least one corrosion inhibitor of the composition contained in the aqueous solution and the surface of the metallic substrate, a protective film is formed on the surface of the metallic substrate; and wherein the protective film formed on the surface of the metallic substrate provides the surface of the metallic substrate with protection against corrosion.

The method may further include: detecting, via a sensor, the aqueous solution in contact with the surface of the metallic substrate; and applying vibration to at least one of the surface of the metallic substrate and the aqueous solution containing the at least one corrosion inhibitor to facilitate the interaction of the at least one corrosion inhibitor with the surface of the metallic substrate and formation of the protective film on the surface of the metallic substrate.

The above described exemplary embodiments advantageously provide effective methods of protecting metallic substrates (and in particular, hard-to-reach metallic substrates) against corrosion. As such, the systems and methods described herein provide ways to protect metallic components of aircraft engines without having to disassemble the engine, thereby providing an efficient and cost-effective solution to corrosion of aircraft engine components.

Those skilled in the art will recognize that a wide variety of other modifications, alterations, and combinations can also be made with respect to the above described embodiments without departing from the scope of the disclosure, and that such modifications, alterations, and combinations are to be viewed as being within the ambit of the inventive concept.

What is claimed is:

1. A method of protecting a metallic substrate from corrosion, the method comprising:

introducing a composition including at least one corrosion inhibitor into a crevice that extends across one or more protective layers covering the metallic substrate to deliver the composition via the crevice into an aqueous solution that contacts a surface of the metallic substrate such that the composition dissolves in the aqueous solution;

wherein, in response to an interaction between the at least one corrosion inhibitor of the composition contained in the aqueous solution and the surface of the metallic substrate, a protective film is formed on the surface of the metallic substrate, and wherein the protective film formed on the surface of the metallic substrate provides the surface of the metallic substrate with protection against corrosion.

2. The method of claim 1, further comprising applying vibration to at least one of the surface of the metallic substrate and the aqueous solution containing the at least one corrosion inhibitor to facilitate the interaction of the at least one corrosion inhibitor with the surface of the metallic substrate and formation of the protective film on the surface of the metallic substrate.

3. The method of claim 1, wherein the composition is in a form of a solution, a dry powder, or a wetted powder.

4. The method of claim 1, wherein the composition includes at least one of an ECHA-compliant corrosion inhibitor and a REACH-compliant corrosion inhibitor.

5. The method of claim 1, wherein the composition includes at least one of 8-hydroxyquinoline, 2,5-dimercapto-1,3,4-thiadiazolate, 1, 2, 4-triazone, cerium (III) chloride, 1,2,3-benzotriazole, 3-amino-1,2,4-triazole, 2-mercaptobenzothiazole, and salicylaldoxime.

6. The method of claim 5, wherein the composition includes 0.015 wt. % 8-hydroxyquinoline and 0.01 wt. % 2,5-dimercapto-1,3,4-thiadiazolate.

7. The method of claim 1, wherein the forming of the protective film comprises bonding of the at least one corrosion inhibitor to intermetallic particles or matrix of the metallic substrate.

8. The method of claim 1, further comprising detecting, via a sensor, the aqueous solution in contact with the surface of the metallic substrate.

9. The method of claim 1, wherein the one or more protective layers covering the metallic substrate include at least one of hexacomb composite, adhesive film, and bond primer, and wherein the metallic substrate is at least one of an aluminum and an aluminum alloy component of an aircraft engine.

10. A system for protecting a metallic substrate from corrosion, the system comprising:

a composition including at least one corrosion inhibitor;

at least two protective layers covering the metallic substrate and including a crevice that extends across the at least two layers to expose a surface of the metallic substrate; wherein the composition is dissolved in an aqueous solution located at the surface of the metallic substrate;

wherein the at least one corrosion inhibitor of the composition contained in the aqueous solution interacts with the surface of the metallic substrate to form a protective film on the surface of the metallic substrate; and wherein the protective film formed on the surface of the metallic substrate provides the metallic substrate with protection against corrosion.

11. The system of claim 10, wherein the metallic substrate is a component of an aircraft, and wherein operation of an engine of the aircraft provides vibration to at least one of the surface of the metallic substrate and the aqueous solution containing the at least one corrosion inhibitor to facilitate interaction of the at least one corrosion inhibitor of the composition with the surface of the metallic substrate and formation of the protective film on the surface of the metallic substrate.

12. The system of claim 10, wherein the composition is in a form of a solution, a dry powder, or a wetted powder.

13. The system of claim 10, wherein the composition includes at least one of an ECHA-compliant corrosion inhibitor and a REACH-compliant corrosion inhibitor.

14. The system of claim 10, wherein the composition includes at least one of 8-hydroxyquinoline, 2,5-dimercapto-1,3,4-thiadiazolate, 1, 2, 4-triazone, cerium (III) chloride, 1,2,3-benzotriazole, 3-amino-1,2,4-triazole, 2-mercaptobenzothiazole, and salicylaldoxime.

15. The system of claim 14, wherein the composition includes 0.015 wt. % 8-hydroxyquinoline and 0.01 wt. % 2,5-dimercapto-1,3,4-thiadiazolate.

16. The system of claim 10, wherein the protective film comprises the at least one corrosion inhibitor bonded to intermetallic particles or matrix of the metallic substrate.

17. The system of claim 10, further comprising a sensor that detects a presence of the aqueous solution at the surface of the metallic substrate.

18. The system of claim 10, wherein the one or more protective layers covering the metallic substrate include at least one of hexacomb composite, adhesive film, and bond primer, and wherein the metallic substrate is at least one of an aluminum and aluminum alloy component of an aircraft engine.

19. A method of protecting a metallic substrate from corrosion, the method comprising:

introducing a composition including at least one corrosion inhibitor into an aqueous solution covering the metallic substrate to dissolve the composition in the aqueous solution and deliver the at least one corrosion inhibitor into contact with a surface of the metallic substrate; and wherein, in response to an interaction between the at least one corrosion inhibitor of the composition contained in the aqueous solution and the surface of the metallic substrate, a protective film is formed on the surface of the metallic substrate; and wherein the protective film formed on the surface of the metallic substrate provides the surface of the metallic substrate with protection against corrosion.

20. The method of claim 19, further comprising at least one of:

detecting, via a sensor, the aqueous solution in contact with the surface of the metallic substrate; and applying vibration to at least one of the surface of the metallic substrate and the aqueous solution containing the at least one corrosion inhibitor to facilitate the interaction of the at least one corrosion inhibitor with the surface of the metallic substrate and formation of the protective film on the surface of the metallic substrate.

* * * * *